US007451756B2

(12) United States Patent
Tippmann, Jr.

(10) Patent No.: US 7,451,756 B2
(45) **Date of Patent: *Nov. 18, 2008**

(54) PAINTBALL SPIN APPLICATION METHOD

(75) Inventor: Dennis J. Tippmann, Jr., Fort Wayne, IN (US)

(73) Assignee: Tippmann Sports LLC, Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/967,490

(22) Filed: Oct. 18, 2004

(65) Prior Publication Data

US 2005/0091900 A1 May 5, 2005

Related U.S. Application Data

(63) Continuation of application No. 09/865,645, filed on May 25, 2001, now Pat. No. 6,805,111, which is a continuation-in-part of application No. 09/333,083, filed on Jun. 14, 1999, now Pat. No. 6,324,779.

(51) Int. Cl.
*F41A 21/16* (2006.01)
*F41B 11/06* (2006.01)

(52) U.S. Cl. ..... 124/81; 124/74; 42/76.01

(58) Field of Classification Search ..... 124/73–74, 124/56, 81, 83; 42/76.01; 89/1.816, 1.818
See application file for complete search history.

(56) References Cited

U.S. PATENT DOCUMENTS

| | | | | |
|---|---|---|---|---|
| 328,713 A | | 10/1885 | Petty | |
| 1,187,218 A | * | 6/1916 | Wister | |
| 1,348,987 A | | 8/1920 | Fischer | |
| 2,119,169 A | | 5/1938 | Lauf | |
| 2,182,369 A | | 12/1939 | Barron | |
| 2,345,089 A | | 3/1944 | Born | |
| 3,101,028 A | | 8/1963 | Berge | |
| 3,329,063 A | | 7/1967 | Ehrenburg et al. | |
| 3,521,616 A | | 7/1970 | Chang et al. | |
| 3,593,698 A | * | 7/1971 | Culas | 124/73 |
| 3,610,222 A | * | 10/1971 | Hartman | 124/81 |
| 3,617,000 A | | 11/1971 | Probst et al. | |
| 3,669,087 A | | 6/1972 | Hamrick et al. | |
| 3,726,266 A | | 4/1973 | Palmer | |
| 3,989,027 A | | 11/1976 | Kahelin | |
| 3,996,916 A | * | 12/1976 | Koehn et al. | 124/72 |
| 4,073,280 A | | 2/1978 | Koehn et al. | |
| 4,094,294 A | | 6/1978 | Speer | |
| 4,249,465 A | | 2/1981 | Ballmann | |
| 4,250,862 A | | 2/1981 | Speer | |
| 4,318,329 A | | 3/1982 | Rentzsch et al. | |

(Continued)

OTHER PUBLICATIONS

*Popular Science*, "New Gun Shoots Around Corners," Mar. 1952.

(Continued)

*Primary Examiner*—Bret Hayes
(74) *Attorney, Agent, or Firm*—Barnes & Thornburg LLP

(57) ABSTRACT

A gun having a firing mechanism and a barrel. The barrel has a breech end coupled to the firing mechanism, a muzzle end, and a bore having a length which extends longitudinally between said breech and muzzle ends. The length of the bore between the breech and muzzle ends is curved.

3 Claims, 6 Drawing Sheets

U.S. PATENT DOCUMENTS

| | | | | | |
|---|---|---|---|---|---|
| 4,335,701 | A | | 6/1982 | Bozich | |
| 4,345,578 | A | * | 8/1982 | Speer | 124/56 |
| 4,354,572 | A | | 10/1982 | Martin | |
| 4,770,153 | A | * | 9/1988 | Edelman | |
| 5,265,583 | A | | 11/1993 | Otto | |
| 5,337,504 | A | | 8/1994 | Krumm | |
| 5,413,085 | A | | 5/1995 | Kraeft | |
| 5,450,838 | A | * | 9/1995 | Nakahigashi et al. | 124/56 |
| 5,613,483 | A | * | 3/1997 | Lukas et al. | 124/73 |
| 5,634,456 | A | | 6/1997 | Perrone | |
| 5,640,945 | A | * | 6/1997 | Slonaker et al. | 124/74 |
| 5,655,510 | A | | 8/1997 | Kunimoto | |
| 5,701,878 | A | * | 12/1997 | Moore et al. | 124/83 |
| 5,735,256 | A | | 4/1998 | Monk | |
| 5,771,875 | A | | 6/1998 | Sullivan | |
| 5,823,173 | A | | 10/1998 | Slonaker et al. | |
| 5,839,422 | A | | 11/1998 | Ferris | |
| 5,878,736 | A | * | 3/1999 | Lotuaco, III | 124/73 |
| 5,913,303 | A | | 6/1999 | Kotsiopoulos | |
| 5,947,100 | A | | 9/1999 | Anderson | |
| 5,988,153 | A | | 11/1999 | Yoshimura | |
| 6,003,504 | A | | 12/1999 | Rice et al. | |
| 6,024,077 | A | | 2/2000 | Kotsiopoulos | |
| 6,138,656 | A | | 10/2000 | Rice et al. | |
| 6,142,136 | A | | 11/2000 | Velasco | |
| 6,142,137 | A | | 11/2000 | MacLaughlin | |
| 6,276,354 | B1 | | 8/2001 | Dillon | |
| 6,324,779 | B1 | | 12/2001 | Tippmann, Jr. | |
| 6,364,737 | B1 | | 4/2002 | Sterr et al. | |
| 6,393,992 | B1 | | 5/2002 | Vasel et al. | |
| 6,520,172 | B2 | * | 2/2003 | Perrone | 124/74 |
| 6,889,682 | B2 | * | 5/2005 | Styles et al. | |
| 2001/0032638 | A1 | | 10/2001 | Yoshimura | |

OTHER PUBLICATIONS

Article I: Kalashnikov Arms Catalog, Military Parade JSC 1997, *Experimental Curved Barrel Machine Gun developed from the RPK Light Machine Gun* (1960), Feb. 4, 2004, www.kalashnikov.guns.ru/models/ka174.html.

Article II: *Maschinenpistole 43/Sturmgewehr 44*, Feb. 4, 2004, www.geocities.com/pentagon/2833/heer/infantry/mp43stg44/mp43stg44.html.

* cited by examiner

PAINTBALL SPIN APPLICATION METHOD

RELATED APPLICATIONS

The present application is a Continuation of U.S. patent application, Ser. No. 09/865,645, filed on May 25, 2001 now U.S. Pat. No. 6,805,111, entitled GUN, which is a Continuation-in-Part of U.S. patent application, Ser. No. 09/333,083, filed Jun. 14, 1999 now U.S. Pat. No. 6,324,779, entitled GUN HAVING A CURVED BARREL. To the extent not included below, the subject matter disclosed in those applications is hereby expressly incorporated into the present application.

TECHNICAL FIELD

The present invention relates generally to guns. More particularly, the present invention is directed to a gun having a curved bore that applies a spin onto a frangible, generally spherical projectile without causing the projectile to rupture.

BACKGROUND AND SUMMARY

A variety of guns for firing frangible, generally spherical projectiles are known in the art. Marking guns, (commonly referred to as paint ball guns) for example, use pressure from compressed gas, such as nitrogen or carbon dioxide, to fire a gelatinous capsule containing a marking material (usually paint). The capsule breaks on impact with a target dispersing the material thereby marking the target. A popular recreational use for marking guns is in "survival games," a kind of mock war where opposing sides attempt to seek out and "shoot" one another with paint balls. Paint ball guns have also been used to segregate cattle within a herd and for a variety of other marking purposes.

Paint balls fired from such guns may have a limited trajectory because of the flight characteristics imposed on them by the amount of force that can be applied and by the configuration of the bore. In some applications, restrictions may exist on the velocity with which the ball may be expelled from the barrel. Consequently, there is a need for a gun that can affect the trajectory of the paint ball by changing its flight characteristics through changes in the gun bore, rather than by increases in force applied to the ball.

It is important to note that paint balls are relatively frangible. It is, therefore, necessary that the structure or method used to improve the trajectory of the paint ball does not cause premature rupture of the ball.

Accordingly, an illustrative embodiment of the present invention provides a gun of the type configured to fire a paint ball. The gun comprising a firing mechanism and a barrel. The firing mechanism defines a first plane. The barrel has a breech end coupled to the firing mechanism for receiving the paint ball, a muzzle end, and a bore having a length which extends longitudinally between said breech and muzzle ends. The length of the bore between the breech and muzzle ends is curved so as to impart a spin to the paint ball as it travels through the bore. A second plane extends the length of the curved bore, as well as extends through both the breech and muzzle ends.

Further embodiments may include a portion of the muzzle end that is positioned above at least a portion of the firing mechanism, a portion of the bore that is not curved, a housing having a top edge and shrouds at least a portion of the barrel and the firing mechanism such that the top edge of the housing defines a plane which simulates a level orientation of the gun, and a firing mechanism that has a longitudinal axis located parallel to the plane. Still further embodiments of the gun may comprise a firing mechanism that is positioned at a non-parallel angle to a line of fire direction of the gun. In addition, the breech end may be positioned at a substantially perpendicular angle to the firing mechanism.

Another embodiment of the present invention provides a paint ball gun. The paint ball gun comprises a paint ball firing mechanism and a barrel. The barrel has a breach end, a muzzle end and a bore extending therebetween. The breech end is in communication with the paint ball firing mechanism and is configured to receive the paint ball into the passage. The bore has an inner wall that forms an arcuate path along which the paint ball travels. The paint ball contacts a portion of the bore when propelled therethrough to impart a spin on the paint ball.

Additional features and advantages of the gun will become apparent to those skilled in the art upon consideration of the following detailed descriptions exemplifying the best mode of carrying out the gun as presently perceived.

BRIEF DESCRIPTION OF DRAWINGS

The present invention will be described hereafter with reference to the attached drawings which are given as non-limiting examples only, in which.

Corresponding reference characters indicate corresponding parts throughout the several figures. The exemplification set out herein illustrates preferred embodiments of the invention and such exemplification is not to be construed as limiting the scope of the invention in any manner.

DETAILED DESCRIPTION OF THE DRAWINGS

The present invention relates generally to guns. More particularly, the present invention is directed to a gun having a slightly curved bore that applies a spin onto a frangible, generally spherical projectile without causing the projectile to rupture. The gun of the present invention may use any conventional force to expel the projectile from the bore. The gun may be of any conventional size and shape. In addition, the gun may provide for any conventional firing mechanism, as well as any generally spherical projectile.

The following description is but one embodiment of the curved bore air gun, and will be described with reference to FIGS. 1-5. While the described embodiments are considered by the inventor to be the best mode of carrying out the invention, it should be understood that the claims presented below are not limited to the particular details of the described embodiments. Numerous variations may be readily apparent to those of skill in the art which would provide for construction of the curved bore gas powered gun which incorporate the principles of the present invention as claimed.

Figure 1:
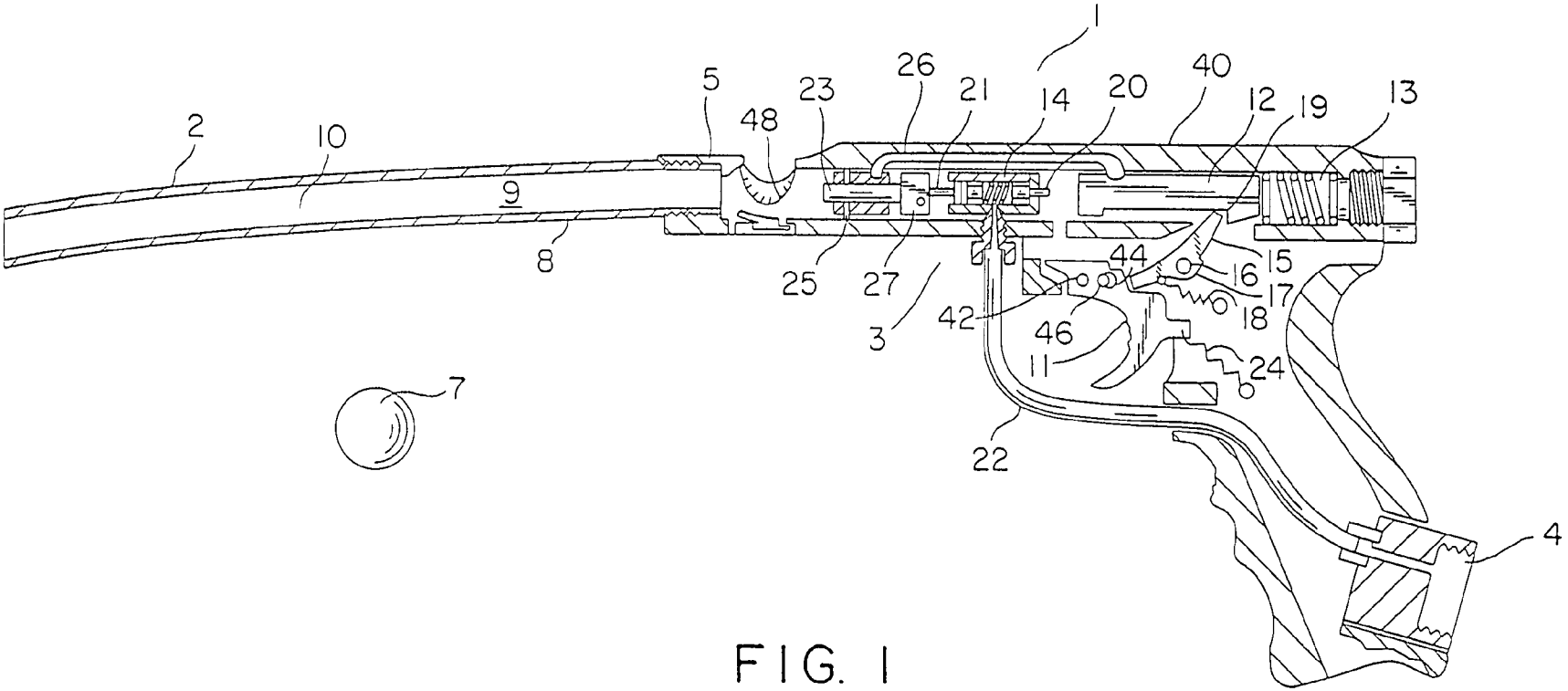
FIG. 1 is a cross-sectional, side-elevation view of a gas powered gun including one embodiment of the present invention.

Gun 1, shown in FIG. 1, comprises three major assemblies: a barrel 2, a firing mechanism 3, and a propellant source means (e.g., gas source inlet 4).

Barrel 2 comprises a breech end 5 and a muzzle end 6. Breech end 5 of barrel 2 attaches to firing mechanism 3. Muzzle end 6 of barrel 2 expels a frangible generally spherical projectile 7 when gun 1 is fired. (See also FIG. 2.) A bore 8 is formed along the longitudinal extent 9 of barrel 2. Bore 8 creates a slightly curved path 10 along the longitudinal extent 9 of barrel 2. In one illustrative embodiment, bore 8 is curved through barrel 2 which is itself curved. Illustratively, a slightly curved path may be bored through a substantially straight barrel. In either case, gun bore 8 should have a generally large radius of curvature of about 40 degrees to about 60 degrees. Illustratively, the barrel may have about a 52½ degree radius for a 12 inch barrel. In addition, muzzle 6 is illustratively perpendicular to the radius of curvature of bore 8.

Figure 4:
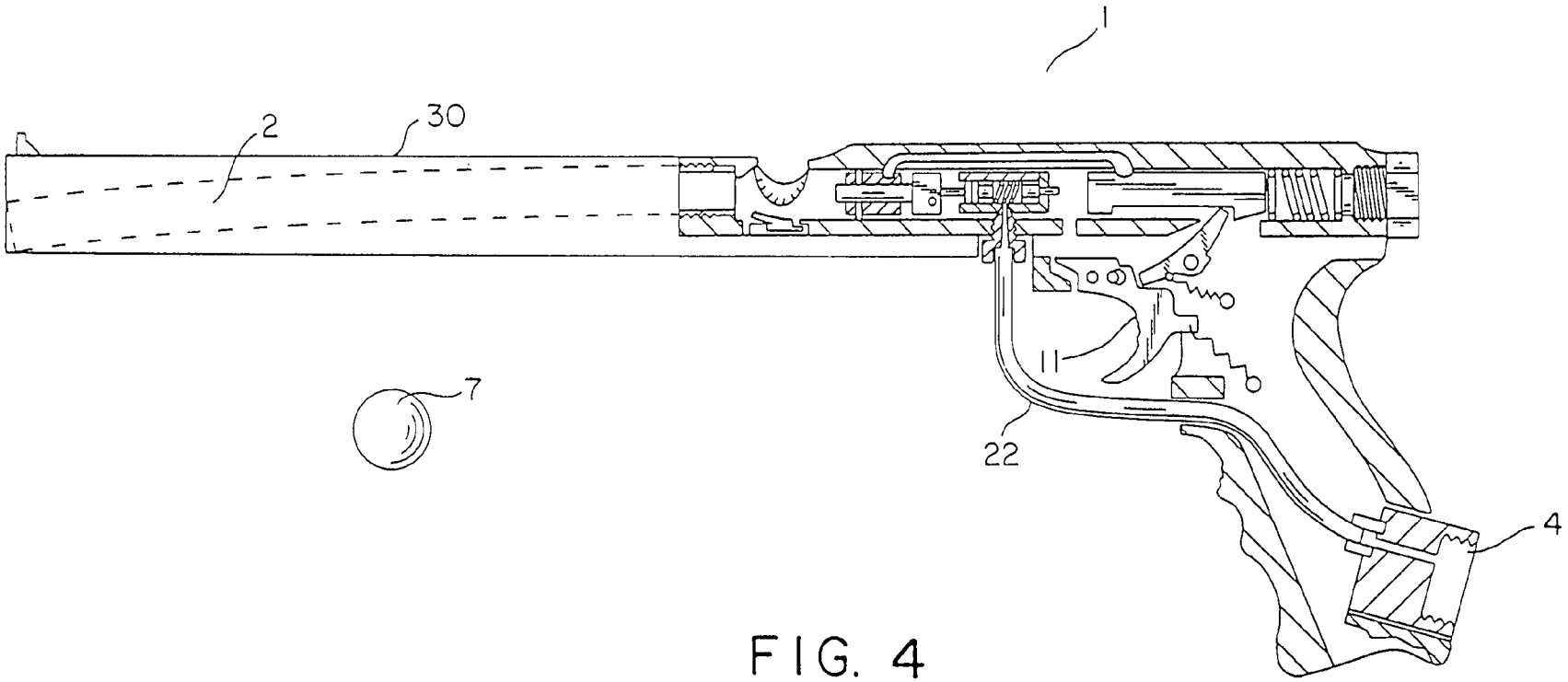
FIG. 4 is a cross-sectional, side-elevation view of another embodiment of a gas powered gun.

Barrel 2 is connectable to a body 40, illustratively, by a series of threads, as best shown in FIG. 4. It is appreciated, however, that barrel 2 may be connected to body 40 by any variety of conventional ways. For example, the barrel may be lock-fit, friction fit or even be an integral part of body 40. In addition, breech end 5 might be angled to affect the direction projectile 7 travels once it leaves muzzle end 6. (See also FIG. 5.)

Body 40 is configured to house all the components of firing mechanism 3. Any conventional firing mechanism may be used to fire the projectile through bore 8. Illustratively, firing mechanism 3 comprises a trigger 11 which is user actuable, and a recoil slide 12 which is movable under the bias of a spring 13 upon actuation of trigger 11. Firing mechanism 3 also comprises a valve assembly 14, illustratively, actuable by slide impact to selectively release a quantity of compressed gas, thereby causing the force to expel frangible, generally spherical projectile 7 through bore 8. It will be appreciated that valve assembly 14 may be replaced with any comparable assembly that selectively releases a quantity of gas to force the expulsion of generally spherical projectile 7 through bore 8.

Gas inlet 4 is designed to receive any variety of sources of gas. For example, inlet 4 may be configured to connect directly to a compressed gas tank or a canister. Or, inlet 4 may connect to a hose which also connects to a gas source. Either way, gas inlet 4 is interposed between the gas source (not shown) and valve assembly 14. Gas inlet 4 supplies gas to valve assembly 14, illustratively, by way of a hollow trigger guard tube 22 connectable to both.

Trigger 11 is attached to housing 40 by pivot pin 42 and has an allowable range of movement defined by elongated aperture 44 and pin 46. The illustrative range of movement extends to that of a typically pulled trigger. A pivotable lever 15 is interposed between trigger 11 and recoil slide 12. Lever 15 has a hole 16 disposed therethrough which is slightly elongated about its axis of rotation and which receives pivot pin 17. Lever 15 is biased by spring 18 in a counterclockwise direction about pin 17 so that lever 15 catches notch 19 in recoil slide 12, holding recoil slide 12 in its rearward or "cocked" position ready to fire. Discharge of gun 1 is caused by actuation of trigger 4. When trigger 11 is pulled, as shown by the hatched outline of trigger 11, elongated hole 16 allows lever 15 to migrate about pivot pin 17 and slip past the end of trigger 11, releasing slide 12.

Illustratively, recoil slide 12, projectile 7 (once it is placed in firing mechanism chamber 48), and valve assembly 14 are all axially-aligned with the breech end 5 of barrel 2. Valve assembly 14 is positioned between projectile 7 and recoil slide 12 and is slightly movable along this common axis within predetermined limits. Valve assembly 14 receives the pressurized gas from hose 22. To release the gas, valve assembly 14 includes impact valves positioned at each axial end thereof. First impact valve 20 faces recoil slide 12, and second impact valve 21 faces breech end 5. After recoil slide 12 is released, spring 13 biases recoil slide 12 toward impact valve 20. Shuttle 25, axially-fitted about funnel 23 and connected to recoil slide 12 via connecting rod 26, moves projectile 7 into bore 8 just past breech end 5. As recoil slide 12 impacts valve 20, valve 20 opens slightly causing a blow-back gas pressure forcing recoil slide 12 back against spring 13. The recoil slide lever 15 catches notch 19 in recoil slide 12, holding it in its "cocked" position.

Force from recoil slide 12, impacting valve 20, not only causes that valve to open, but it also causes the entire valve assembly 14 to move slightly forward toward breech end 5. This forward movement causes impact valve 21 to engage a transverse bar 27 inside funnel 23, thereby slightly opening valve 21 and allowing the gas under pressure to expel through funnel 23. The force from this pressure propels projectile 7 through bore 8. It is appreciated that curved bore 8 may attach to any type of firing mechanism. This firing mechanism described is for illustrative purposes only. It is appreciated that any mechanism for accelerating the projectile may be used. For example, such mechanisms include nitrogen under pressure, ignited propane, oxygen, and/or butane, and springs.

Figure 2:
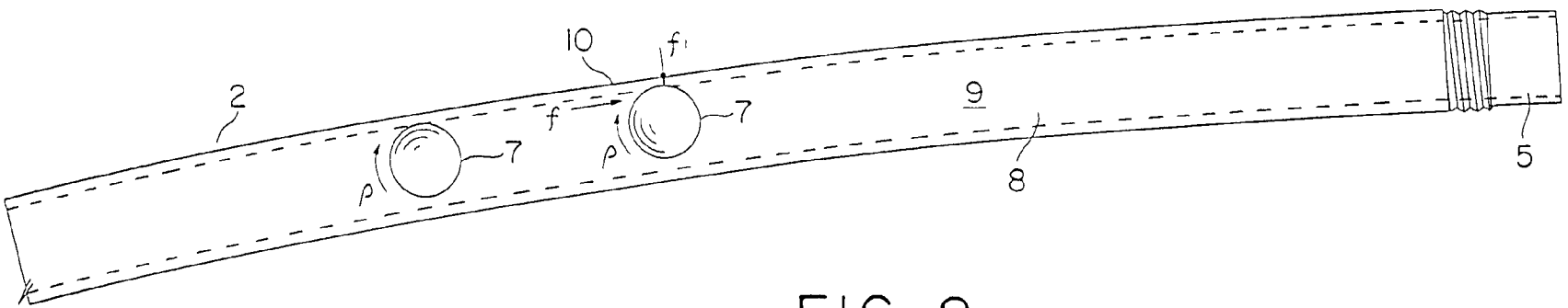
FIG. 2 is a cross-sectional, side-elevation view of a portion of the gas powered gun from FIG. 1.

The manner in which projectile 7 travels through bore 8 is best illustrated in FIG. 2. As projectile 7 travels through bore 8, it contacts a slightly curved path 10. Centripetal force acting on projectile 7 causes it to contact upper surface 28, creating friction f, imparting a rotational velocity $\dot{y}$ onto spherical projectile 7. This rotation $\dot{y}$ continues as a back-spin. Once projectile 7 exits barrel 2, the back-spin motion counteracts the force of gravity creating substantially improved trajectory.

Frangible, generally spherical projectile 7 is typically a paint ball. Because these paint balls are designed to rupture on impact, they are usually relatively frangible. The slight curvature of the bore of the barrel is effective to back-spin to the projectile, while not rupturing it prematurely. If the radius of curvature barrel 2 is too small, friction f or centripetal force f' acting on the ball may rupture projectile 7. As previously stated, an illustratively preferable radius of curvature for bore 8 is about 40 inches to about 60 inches.

Figure 3:
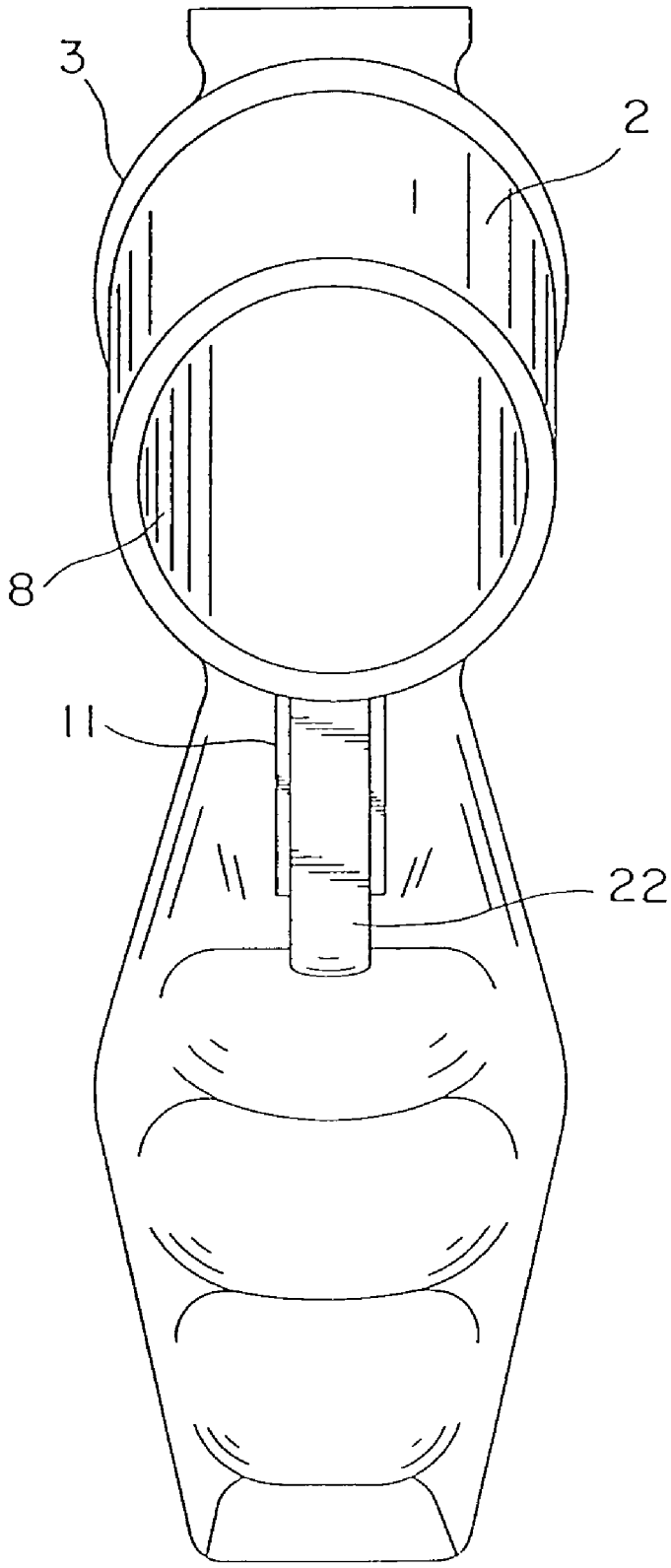
FIG. 3 is a front elevation view of a portion of the gas powered gun from FIG. 1.

The extent of the curvature of bore 8 may be well appreciated as shown in FIG. 3. It will be appreciated that in one illustrative embodiment, the inner diameter of bore 8 remains substantially constant along its longitudinal extent 9. (See also FIG. 2.) The internal diameter of bore 8 is determined by the size of the paint ball or other projectile used. In one illustrative embodiment, the diameter of bore 8 may be slightly larger than the diameter of projectile 7. This is so that as projectile 7 propels through bore 8 and contacts upper surface 28, projectile 7 has sufficient clearance to rotate through bore 8 without interference by any other part of the bore. In addition, sufficient clearance illustratively includes taking into account any deformation that might occur to projectile 7 as it travels through bore 8.

Because a curved barrel may cause disorientation to an operator who is used to aiming a gun along a straight barrel, a shroud 30 may be fitted over barrel 2, as shown in FIG. 4. The operator, therefore, may now be able to aim along shroud 30 of gun 1 just as he/she would a straight barrel. The shroud 30 may be made from any myriad of materials including aluminum, steel, plastic or some type of fiberglass, for example. The shroud can also be configured in any myriad of ways so as to give the user of the gun the impression of a gun having a straight barrel.

Figure 5:
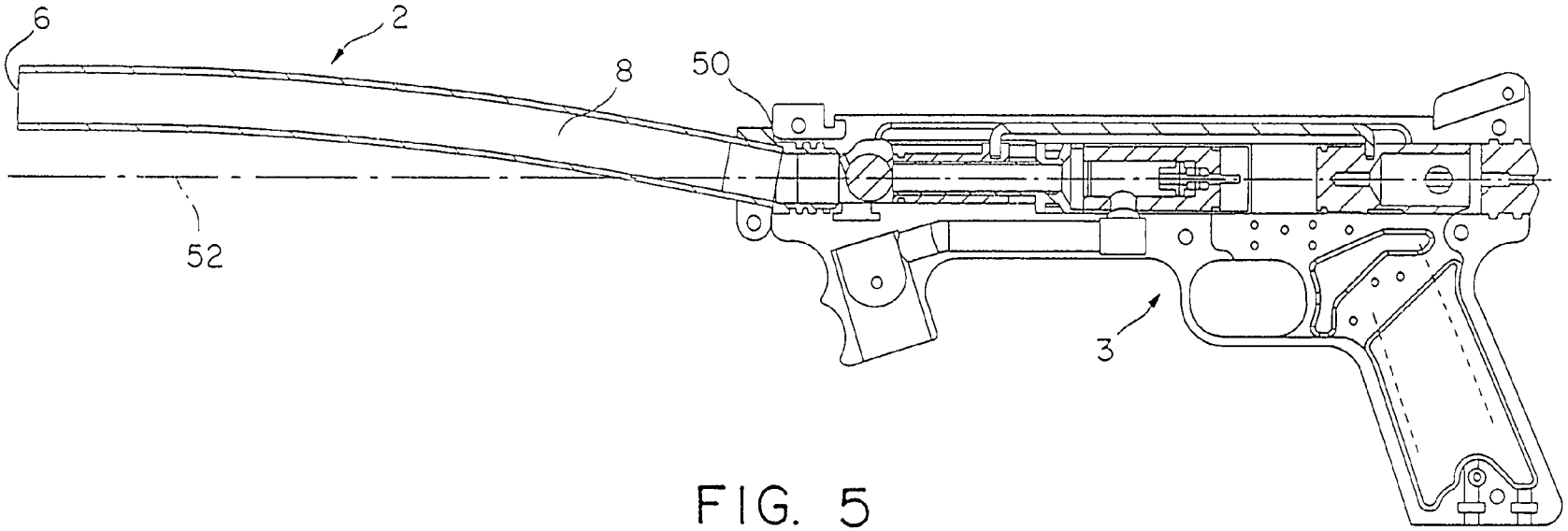
FIG. 5 is a cross-sectional, side-elevation view of a further embodiment of a gas powered gun.

In another illustrative embodiment, barrel 2 having curved bore 8 may be positioned at an angle relative to the firing mechanism such that muzzle end 6 is substantially perpendicular to longitudinal axis 52 of firing mechanism 3. Projectile 7 will exit muzzle 6 traveling along a path parallel to line 52. This is advantageous from the standpoint that projectile 7, as it is projected from muzzle 6, will travel in generally the same direction as gun 1 is pointing. Because of the aerodynamic effects spin creates, the projectile may have an improved trajectory when the gun is fired in a typical, upright orientation. When the gun is oriented in an alternative position, (e.g., sideways) the spin causes the projectile to a laterally curved trajectory. Illustratively, the angle of muzzle 6 may be changed by changing the angle of breech end 5. An angled breech end 50, as shown in FIG. 5, affects the angle of muzzle end 6. (Compare to FIG. 1.) As a result, the changed angle of muzzle end 6 changes the angle with which projectile 7 exits bore 8. Furthermore, breech end 2 might be rotatably attached to firing mechanism 3 such that bore 8 may be selectively angled with respect to firing mechanism 3 along one or more axis to change the direction the ball shoots.

Traditional aiming means, like sights and scopes, may be attached to the gun embodying the present invention, just as they would other guns. For this present embodiment, the illustrative line of sight is preferably raised such that the line of sight be above muzzle end 6. In addition, it may be preferable to ensure the line of sight be perpendicular with muzzle end 6. This will ensure that projectile 7 will travel in the same general direction as the sight is aiming.

Figure 6:
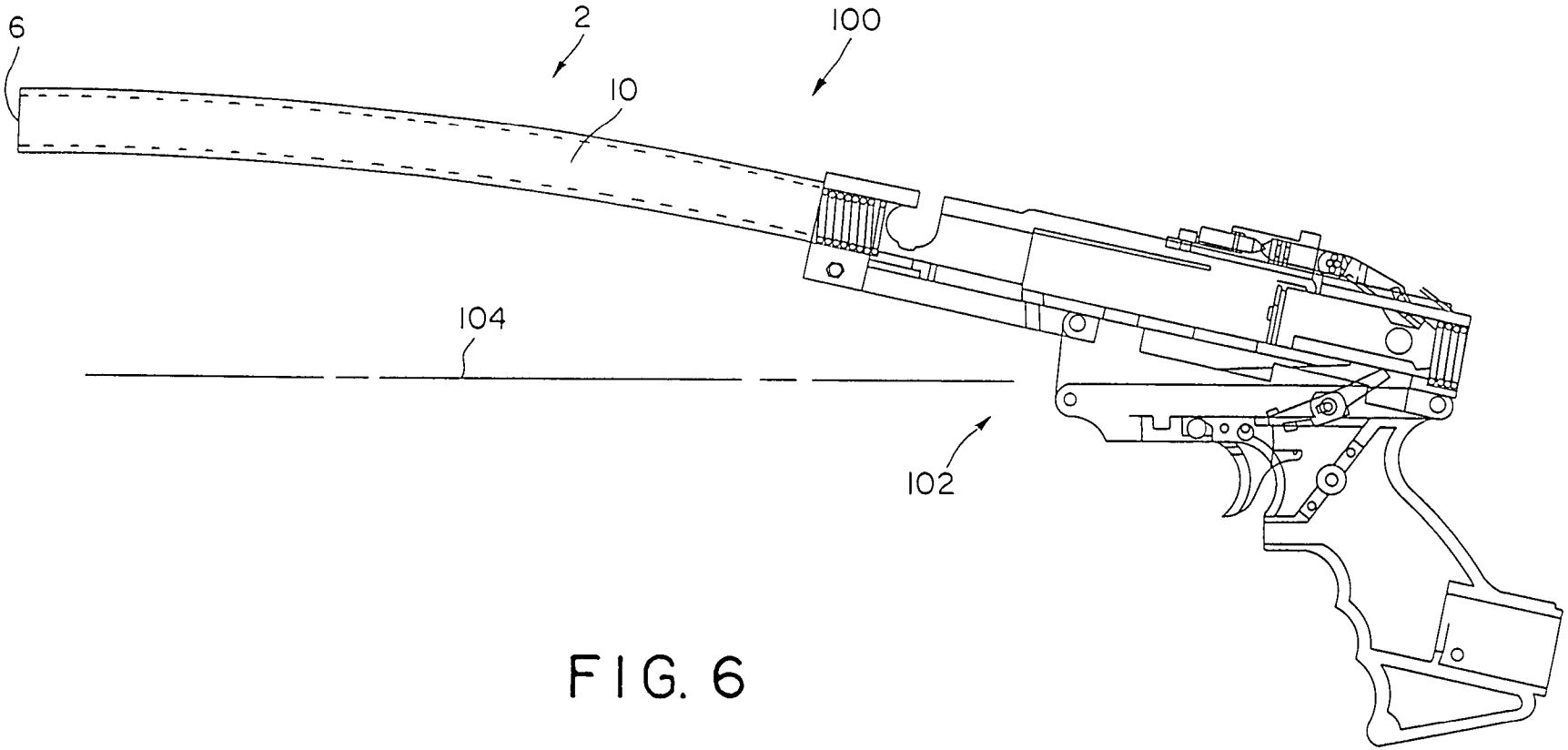
FIG. 6 is a cross-sectional, side-elevation view of another embodiment of a gas powered gun.

Another embodiment of a paint ball gun 100 is shown in FIG. 6. Gun 100 comprises many of the same structures as the previous embodiments, but for a portion of the firing mechanism 102 which is angled. Angled firing mechanism 102 is set at an angle of about 12.5 degrees from line of fire 104, and can be set at a range of angles of about 10-15 degrees from line of fire 104. It is appreciated that this range of angles can be changed to effect various shooting characteristics or firing directions. In the illustrated embodiment, the muzzle end 6 of barrel 2 is oriented generally perpendicular to the line of fire 104. This is so that gun 100 will fire the paint ball in the general direction the gun is pointed. In addition, this allows gun 100, having an angled firing mechanism and a curved bore, to provide a similar "feel" as a conventional gun would provide.

As further shown in the illustrated embodiment, firing mechanism 102 is angled to allow a paint ball to enter barrel 2 at breach end 5 along a linear path, while bore 10 still provides the curved path, and the ball exits muzzle end 6 generally parallel to the line of fire 104. This is in contrast to the embodiment that is shown in FIG. 5, wherein, projectile 7 enters bore 8 at an angle at breech end 50 and then proceeds along the curved path and exit the muzzle end. (See also FIG. 4.)

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A method of applying spin on a paintball fired from a paintball gun, the method comprising the steps of:

using a firing mechanism that is part of the paintball gun to accelerate the paintball through a bore of the paintball gun such that the paintball travels along a path extending from the firing mechanism, wherein the bore has a muzzle end, wherein only a single section of the path changes angle and wherein the bore does not have a rifled surface or additional frictional material;

causing a portion of the paintball to contact a first surface at the single section where the path changes angle without rupturing prior to exiting the paintball gun such that friction between the first surface and the paintball imparts a backspin on the paintball which persists after the paintball exits the paintball gun, and the first surface is longitudinally-extending along the path of travel of the paintball and is curved transverse to the path of travel of the paintball; and expelling the paintball from the paintball gun to cause the paintball to contact a second surface and rupture, spilling its contents on the second surface.

2. The method of claim 1, further comprising the step of providing at least a portion of the first surface, where it is curved transverse to the path of travel and is contacted by the paintball, is at least partially circumferentially shaped approximately the same as a portion of the paint ball.

3. A method of applying a spin on a paintball fired from a paintball gun, the method comprising the steps of:

using a firing mechanism that is part of the paintball gun to accelerate the paintball through a bore of the paintball gun;

wherein the paintball travels along a path that extends from the firing mechanism along a slight bend in the bore, wherein the bore has a muzzle end and no rifling or additional frictional material, and wherein the slight bend is located adjacent the muzzle end and is the only bend extending along the path the paintball travels;

causing a portion of the paintball to contact a first surface along the slight bend prior to exiting the paintball gun such that friction between the first surface and the paintball imparts a backspin on the paintball which persists after the paintball exits the paintball gun; and causing the paintball to impact a second surface wherein the paintball ruptures exposing its contents.

* * * * *